United States Patent [19]

Nongbri et al.

[11] Patent Number: 4,576,710

[45] Date of Patent: Mar. 18, 1986

[54] CATALYST DESULFURIZATION OF PETROLEUM RESIDUA FEEDSTOCKS

[75] Inventors: Govanon Nongbri, Newtown, Pa.; Michael C. Chervenak, Pennington, N.J.

[73] Assignee: HRI, Inc., Gibbsboro, N.J.

[21] Appl. No.: 672,841

[22] Filed: Nov. 9, 1984

Related U.S. Application Data

[63] Continuation of Ser. No. 414,708, Sep. 3, 1982, abandoned.

[51] Int. Cl.[4] ..... C10G 65/04; C10G 65/12

[52] U.S. Cl. ..... 208/58; 208/59; 208/210; 208/213; 502/38

[58] Field of Search ..... 208/58, 59, 210, 213

[56] References Cited

U.S. PATENT DOCUMENTS

| | | | |
|---|---|---|---|
| 3,553,105 | 1/1971 | Layng et al. | 208/213 |
| 3,639,230 | 2/1972 | Oguchi et al. | 208/213 |
| 3,705,849 | 12/1972 | Alpert et al. | 208/59 |
| 3,705,850 | 12/1972 | Wolk | 208/127 |
| 3,809,644 | 5/1974 | Johnson et al. | 208/210 |
| 3,893,911 | 7/1975 | Rovesti et al. | 208/251 H |
| 3,901,792 | 8/1975 | Wolk et al. | 208/210 |
| 3,932,269 | 1/1976 | Lehman | 208/157 |

*Primary Examiner*—John Doll
*Assistant Examiner*—O. Chaudhuri
*Attorney, Agent, or Firm*—Fred A. Wilson

[57] ABSTRACT

An improved process for catalytic desulfurization of petroleum residua feedstocks to provide at least about 75% desulfurization of the liquid product while achieving low catalyst deactivation and increased catalyst age. In the process which uses an ebullated catalyst bed reactor, the reaction conditions are usually maintained at 790°-860° F. temperature, 1000-1800 psig hydrogen partial pressure, and 0.2-2.0 Vf/hr/Vr space velocity. To control carbon and metals deposition on the catalyst, used catalyst is withdrawn from the reactor, a minor portion of the catalyst is discarded to control metals deposition and maintain catalyst activity, and the remaining catalyst is regenerated to remove carbon by carbon burnoff and returned to the reactor for further use. If desired, the regenerated catalyst can be presulfided before returning it to the reactor. Following phase separation and distillation steps, the desulfurized hydrocarbon liquid products are withdrawn from the process. For feedstocks requiring higher desulfurization, two stages of catalytic reaction are provided in which the used catalyst is withdrawn from each stage reactor and regenerated to remove carbon and then returned to the same stage reactor. Alternatively, fresh catalyst is added to the second stage only, some used catalyst from the second stage reactor is transferred to the first stage reactor, and used catalyst is discarded from the first stage reactor.

12 Claims, 3 Drawing Figures

CATALYST DESULFURIZATION OF PETROLEUM RESIDUA FEEDSTOCKS

This application is a continuation of application Ser. No. 414,708, filed Sept. 3, 1982 now abandoned.

BACKGROUND OF INVENTION

This invention pertains to a process for high catalytic desulfurization of petroleum residua feedstocks to produce desulfurized hydrocarbon liquid products along with low net catalyst consumption. It pertains particularly to such process in which the hydrodesulfurization reaction is performed at higher temperature and lower pressure than normally used, along with high catalyst withdrawal and regeneration rate to minimize effective catalyst deactivation rate and increase catalyst age.

In catalyst desulfurization operations on petroleum residua feedstocks along with accompanying demetallization and denitrogenation reactions, use of high activity catalyst results in high deactivation rate for the catalyst due to carbon loading on the catalyst. A similar problem was recognized in U.S. Pat. No. 3,932,269 to Lehman, who disclosed a process for catalytic hydrocracking of petroleum residue feedstock using higher temperature and lower pressure than usual and using high catalyst replacement rates. But that process does not provide for a desired high level of desulfurization of the feedstock. Also, U.S. Pat. No. 3,893,911 to Rovesti, et al discloses a catalytic demetallization process for petroleum feedstock containing high metals content in which used catalyst is regenerated and returned to the reactor. However, a catalytic process for achieving high percentage desulfurization of petroleum residua with low consumption of fresh catalyst and increased catalyst age has evidently not previously been available.

SUMMARY OF INVENTION

The present invention provides an improved process for catalytic desulfurization of heavy petroleum residua feedstocks containing at least about 2 W % sulfur to achieve a high percentage desulfurization of the feedstock and produce lower boiling hydrocarbon liquid products, while limiting effective catalyst deactivation rate and thus increasing catalyst age. The process comprises feeding a petroleum residua feedstock together with hydrogen into a reaction zone containing an ebullated bed of high activity desulfurization catalyst maintained at 790°–860° F. temperature, 1000–1800 psig hydrogen partial pressure and 0.2–2.0 $V_f/hr/V_r$ liquid space velocity and catalyst space velocity of 0.02–0.4 barrel/day/pound catalyst to achieve at least about 75% desulfurization of the feed and to produce a hydroconverted and desulfurized hydrocarbon material. Used catalyst is withdrawn from the reaction zone at a rate of at least about 0.4 lb catalyst/bbl feed/per day, a portion of the used catalyst is discarded to control metals deposition and accompanying catalyst deactivation, and the remainder of the catalyst is regenerated to remove substantially all carbon, after which the regenerated catalyst is returned to the reaction zone for further use to minimize catalyst deactivation and increase catalyst age. The hydroconverted desulfurized hydrocarbon material is withdrawn from the reaction zone, phase-separated and distilled to produce gas and lower boiling desulfurized hydrocarbon liquid products.

It is noted that in the present invention the reaction zone temperature is increased to above that normally used for catalyst desulfurization operations and the hydrogen partial pressure is reduced to below the normally used range, and an above normal degree of coking is permitted on the catalyst. The used catalyst containing coke deposits is withdrawn from the reaction zone at a rate at least about 0.4 pounds catalyst/bbl feed/per day, the catalyst is regenerated by carbon burn-off and then returned to the reaction zone for further use. A portion of the used catalyst withdrawn is discarded, so as to limit deposition of metals such as nickel and vanadium on the catalyst in the reaction zone and maintain the associated deactivation of the catalyst to an acceptable level. If desired, the used regenerated catalyst as well as the fresh catalyst can be presulfided before introducing it into the reaction zone. By using the present invention, the effective deactivation rate of the catalyst is substantially reduced and the catalyst age is increased to about 5.0 bbl/pounds.

For processing residua feedstocks which contain more sulfur and less than about 400 ppm total metals, usually consisting mainly of nickel and vanadium, the process preferably uses two stages of catalytic reaction connected in series. Used catalyst is withdrawn from each stage reaction zone, a portion of the withdrawn catalyst is discarded to control metals deposition and deactivation of the remaining catalyst to a minimum desired level, and the remaining catalyst is regenerated to remove substantially all carbon by carbon burn-off, and the catalyst then returned to the same stage reaction zone for further use. Fresh catalyst is added to the second stage reaction zone only, a portion of the used catalyst withdrawn from the second stage reaction zone is transferred to the first stage reaction zone, and a portion of the used catalyst withdrawn from the first stage reaction zone is discarded. Such use of two reactors connected in series flow arrangement permits the catalyst deactivation rate to be minimized and the catalyst age to be increased further, particularly for those feedstocks containing increased sulfur and total metals concentrations less than about 400 ppm.

DETAILED DESCRIPTION OF INVENTION

Figure 1:
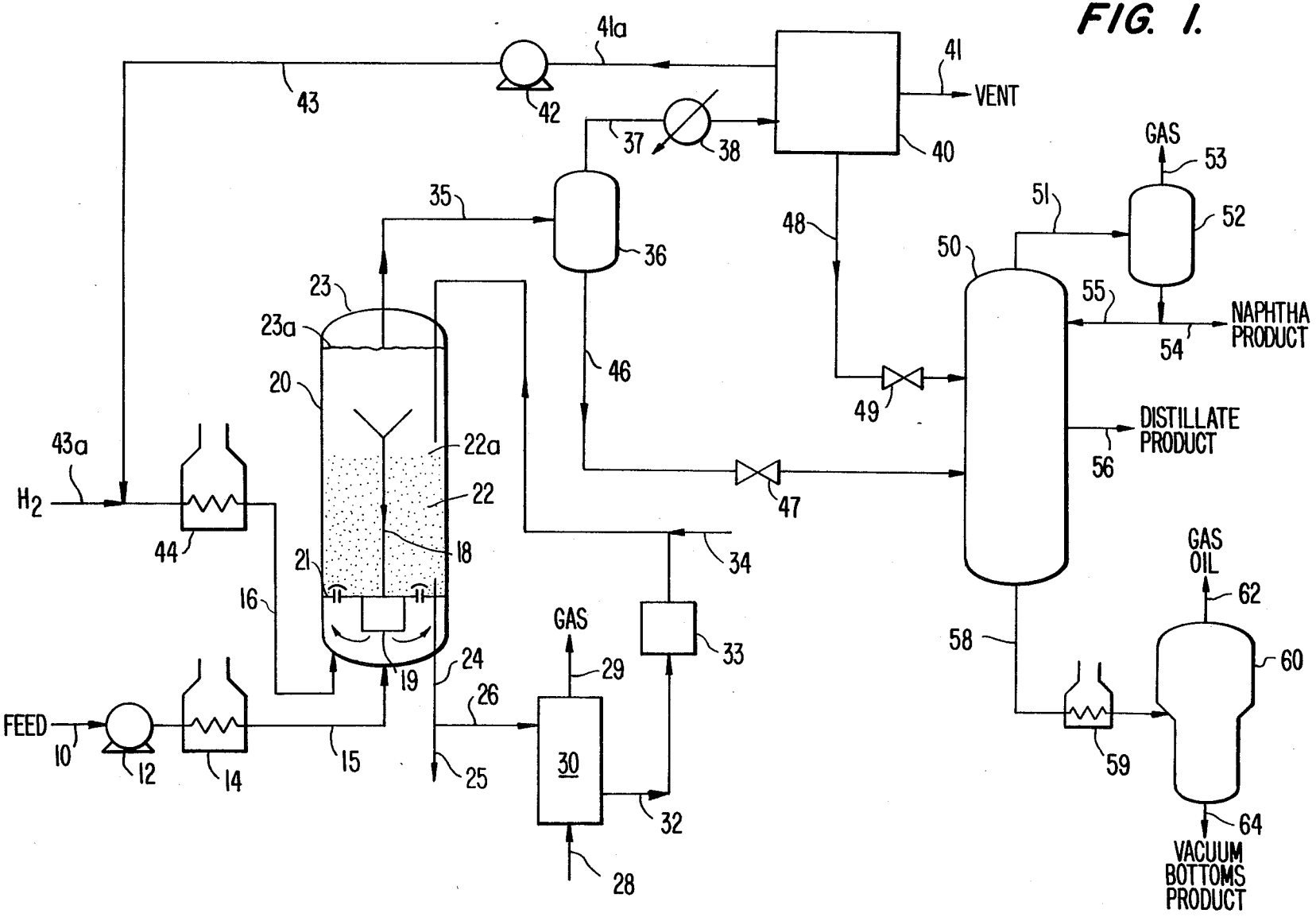
FIG. 1 is a schematic flow diagram of a catalytic desulfurization process for petroleum residua feedstocks in accordance with the present invention.

The invention is further described as used in a single stage desulfurization process for petroleum residua. As illustrated by FIG. 1, a heavy petroleum residua feedstock is provided at 10, such as Kuwait vacuum bottoms, containing 3–6 W % sulfur is pressurized by pump 12 and passed through preheater 14 for heating to at least about 500° F. The heated feedstream at 15 is fed into upflow ebullated bed catalytic reactor 20. Heated hydrogen is provided at 16, and is also introduced with the feedstock into reactor 20. The reactor 20 has an inlet flow distributor and catalyst support grid 21, so that the feed liquid and gas passing upwardly through the reactor 20 will expand the catalyst bed 22 by at least about 10% and usually up to about 50% over its settled height, and place the catalyst in random motion in the liquid. This reactor is typical of that described in U.S. Pat. No. Re. 25,770, wherein a liquid phase reaction occurs in the presence of a reactant gas and a particulate catalyst such that the catalyst bed is expanded.

The catalyst particles in bed 22 usually have a relatively narrow size range for uniform bed expansion under controlled liquid and gas upward flow conditions. While the useful catalyst size range is between 6 and 100 mesh (U.S. Sieve Series) with an upflow liquid velocity between about 1.5 and 15 cubic feet per minute per square foot of reactor cross section area, the catalyst size is preferably particles of 6 and 60 mesh size (U.S. Sieve Series) including extrudates of approximately 0.010–0.130 inch diameter. We also contemplate using a once-through type operation using fine sized catalyst in the 80–270 mesh size range (0.002–0.007 inch) with a liquid space velocity in the order of 0.2–15 cubic feet per minute per square foot of reactor cross-section area. In the reactor, the density of the catalyst particles, the liquid upward flow rate, and the lifting effect of the upflowing hydrogen gas are important factors in the expansion and operation of the catalyst bed. By control of the catalyst particle size and density and the liquid and gas velocities and taking into account the viscosity of the liquid at the operating conditions, the catalyst bed 22 is expanded to have an upper level or interface in the liquid as indicated at 22*a*. The catalyst bed expansion should be at least about 10% and seldom more than 100% of the bed settled or static level.

The desulfurization and heteratom removal reaction in bed 22 is greatly facilitated by use of an effective catalyst. The catalysts useful in this invention are typical hydrodesulfurization catalysts containing activation metals selected from the group consisting of cobalt, molybdenum, nickel and tungsten and mixtures thereof, deposited on a support material selected from the group of alumina, silica, and combinations thereof. If a fine-size catalyst is used, it can be effectively introduced to the reactor at connection 24 by being added to the feed in the desired concentration, as in a slurry. Catalyst may also be periodically added directly into the reactor 20 through suitable inlet connection means at a suitable rate, and used catalyst is withdrawn through suitable withdrawal means as described below.

Recycle of reactor liquid from above the solids interface 22*a* to below the flow distributor 21 is usually needed to establish a sufficient upflow liquid velocity to maintain the catalyst in random motion in the liquid and to facilitate an effective reaction. Such liquid recycle is preferably accomplished by the use of a central downcomer conduit 18 which extends to a recycle pump 19 located below the flow distributor 21, to assure a positive and controlled upward movement of the liquid through the expanded catalyst bed 22. The recycle of liquid through internal conduit 18 has some mechanical advantages and tends to reduce the external high pressure piping connections needed in a hydrogenation reactor, however, liquid recycle upwardly through the reactor can be established by a recycle pump located external to the reactor.

Operation of the ebullated catalyst bed reactor system to assure good contact and uniform (iso-thermal) temperature therein depends not only on the random motion of the relatively small catalyst in the liquid environment resulting from the buoyant effect of the upflowing liquid and gas, but also requires the proper reaction conditions. With improper reaction conditions insufficient hydroconversion is achieved, which results in a non-uniform distribution of liquid flow and operational upsets, usually resulting in excessive coke deposits on the catalyst.

For the petroleum feedstocks used in this invention, the reaction conditions used in the reactor 20 are within the ranges of 780°–860° F. temperature, 1000–1800 psig hydrogen partial pressure, and liquid space velocity of 0.20–2.0 $V_f/hr/V_r$ (volume feed per hour per volume of reactor). Preferred reaction conditions are 800°–840° F. temperature, 1200–1500 psig hydrogen partial pressure, and space velocity of 0.3–1.5 $V_f/hr/V_r$. The feedstock hydrodesulfurization achieved is at least about 60 W % for a single stage type operations at moderate catalyst replacement rate.

Used catalyst is withdrawn from reactor 20 at conduit 24 and a minor portion is discarded at 25 so as to limit the metals concentration such as nickel and vanadium deposited on the catalyst to not exceed about 30 W % on a fresh catalyst basis. The remaining catalyst at 26 is passed to regenerator 30 which is operated so as to remove substantially all carbon deposits by carbon burnoff. A combustion gas containing 1–6 V % oxygen and the remainder inert gas is introduced into the combuster 30 at conduit 28. The gas flow rate should be 20–30 SCFH per 100 grams catalyst regenerated. The catalyst regeneration temperature should be at least about 800° F., and the maximum allowable temperature in the regenerator is about 900° F. to avoid sintering damage to the catalyst substrate. The burnoff procedure is continued until no $CO_2$ is detected and the combustor effluent gas at 29.

The regenerated catalyst is removed at 32, catalyst fines are removed at 33, and the remainder is returned to the reactor 20 for reuse along with fresh make-up catalyst at 34 substantially equal to the amount of used catalyst discarded at 25. By using a high catalyst withdrawal rate along with regeneration of used catalyst to remove carbon, the effective catalyst deactivation rate is substantially reduced and the catalyst age is increased such as to about 5.0 bbl feed/pound catalyst consumed.

In the catalyst reactor 20, a vapor space 23 exists above the liquid level 23*a* and an overhead stream containing a mixture of both gas and liquid fractions is withdrawn at 35, and passed to hot phase separator 36. The resulting gaseous portion 37, which is principally hydrogen, is cooled at heat exchanger 38, and the hydrogen recovered in gas purification step 40. The recovered hydrogen at 41*a* can be warmed at heat exchanger 38 and recycled by compressor 42 through conduit 43, reheated at heater 44, and is passed along with make-up hydrogen at 43*a* as needed into the bottom of reactor 20.

From phase separator 36, liquid fraction stream 46 is withdrawn, pressure-reduced at 47 to pressure below about 200 psig, and passed to fractionation step 50. A condensed vapor stream also is withdrawn at 48 from gas purification step 40 and also pressure-reduced at 49 and passed to fractionation step 50, from which is withdrawn a low pressure gas stream 51. This vapor stream is phase separated at 52 to provide low pressure gas 53 and liquid stream 55 to provide reflux liquid to fractionator 50 and naphtha product stream 54. A middle boiling range distillate liquid product stream is withdrawn at 56, and a heavy hydrocarbon liquid stream is withdrawn at 58.

From fractionator 50, the heavy oil stream 58 which usually has normal boiling temperature range of 650° F.+ is withdrawn, reheated as needed in heater 59 and passed to vacuum distillation step 60. A vacuum gas oil stream is withdrawn overhead at 62, and vacuum bottoms stream is withdrawn at 64, as bottoms product.

Figure 2:
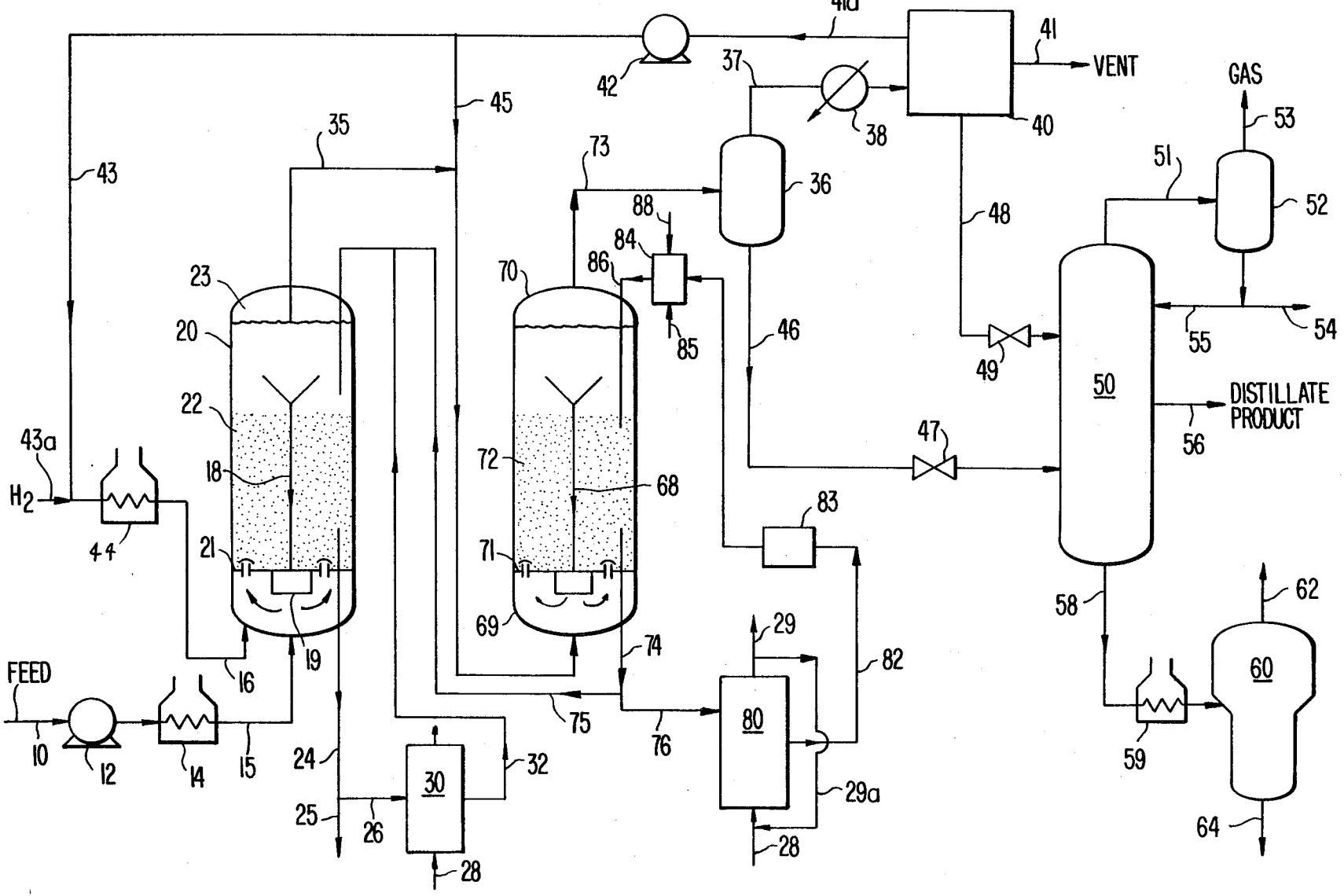
FIG. 2 is a schematic flow diagram of an alternative process for catalytic desulfurization of petroleum residua.

This invention is also useful in a two-stage catalytic desulfurization process. As shown in FIG. 2, the effluent stream 35 from reactor 20 is passed to a second-stage catalytic reactor 70. The operation of this second-stage reactor 70 is quite similar to that of reactor 20, however, slightly higher temperature of 800°-850° F. and lower hydrogen pressure of 950-1750 psig could be used if desired. Recycle hydrogen 45 is added to reactor effluent stream 35 to quench and cool the stream upstream of reactor 70. From reactor 70, effluent stream 73 is removed and passed to hot separator 36. The downstream portion of the FIG. 2 process is essentially the same as for FIG. 1 embodiment.

In FIG. 2, used catalyst is withdrawn from first stage reactor 20 at 24, a portion is discarded at 25, and the remaining catalyst at 26 is passed to regeneration at 30 for removal of substantially all carbon as before. The regenerated catalyst at 32 can have catalyst fines advantageously removed at 33, such as by screening, and returned to reactor 20. Used catalyst is also withdrawn from reactor 70 at 74 and a portion 75 is transferred or backstaged into first reactor 20, and the remainder passed at 76 to catalyst regenerator 80 for carbon removal by burn-off similarly as for regenerator 30. The regenerated catalyst is removed at 82, catalyst fines are removed at 83 and the remainder returned to reactor 70 for reuse. The regenerated catalyst 82 can be presulfided at 84 by addition of a presulfuding material at 85, such as hydrogen sulfide or a mercaptam compound, before returning to regenerated catalyst at 86 to second stage reactor 70. An amount of fresh catalyst is added at 88 which is substantially equal to the catalyst discarded at 25.

This invention will be better understood by reference to the following example of actually hydrodesulfurization operations, and which should not be regarded as limiting the scope of the invention.

EXAMPLE 1

Catalytic hydrodesulfurization operations were conducted on a Kuwait vacuum bottoms petroleum feedstock material in a fixed-bed catalytic reactor at 780°-840° F. temperature and 2000-2700 psig hydrogen partial pressure. The feedstock characteristics are given in Table 1. The catalyst used was a conventional cobalt-molybdenum on alumina desulfurization catalyst in form of 0.030-0.035 inch diameter extrudates.

Figure 3:
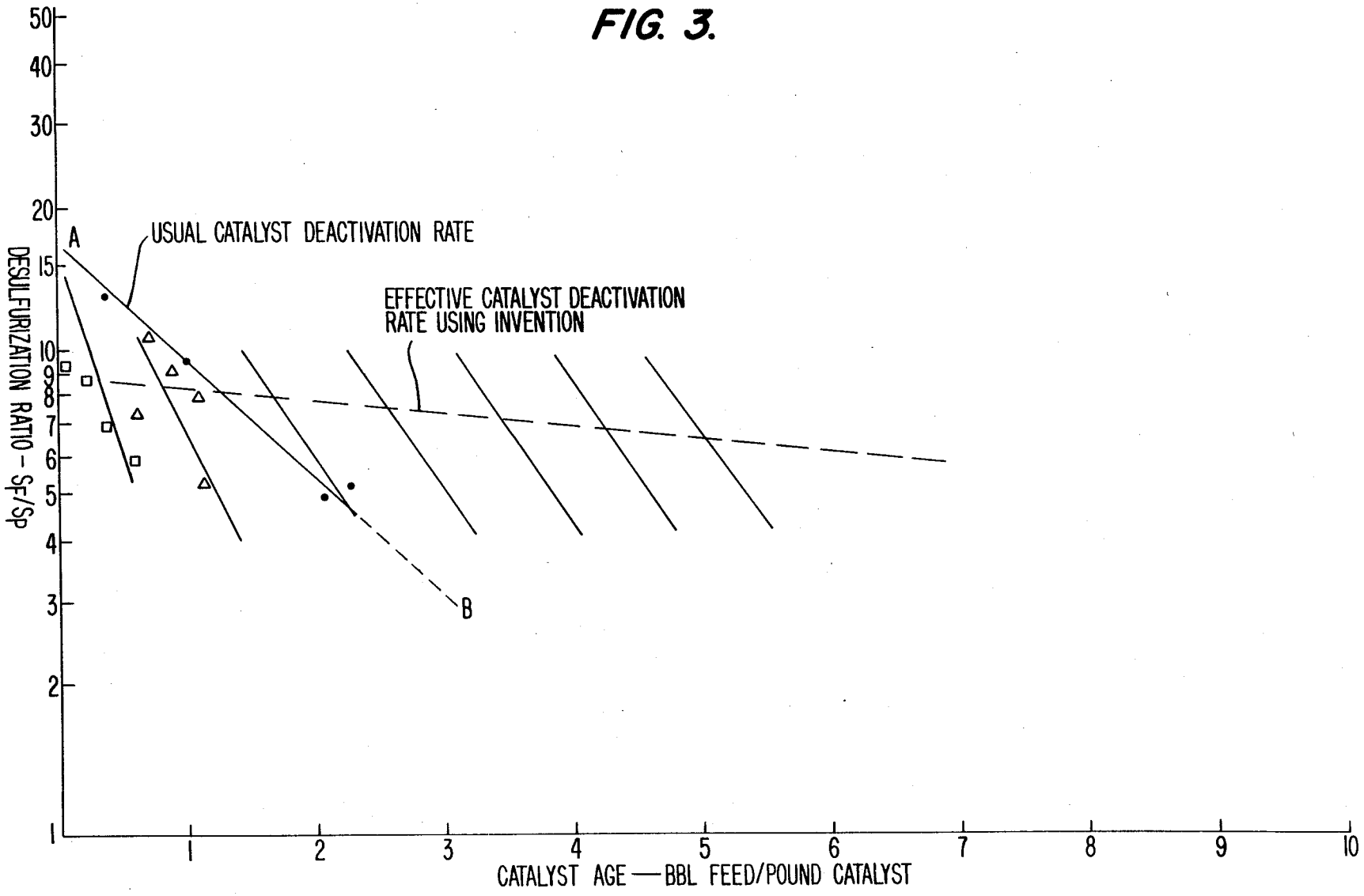
FIG. 3 is a graph showing typical desulfurization process results using repeated regeneration of the catalyst in accordance with the present invention.

It was found that to maintain sufficient catalyst activity to achieve a desired desulfurization of 82%, it was necessary to operate the process at high hydrogen partial pressure of 2250 psig and to use a catalyst replacement of 0.3 pounds/bbl feed, which resulted in undesirably high catalyst consumption and operational costs. The operating conditions and results are shown in Table 1 and the catalyst deactivation is shown as line A—B of FIG. 3.

Subsequent catalytic hydrodesulfurization operations were conducted on the Kuwait vacuum bottoms feedstock material at slightly higher temperature of 800° F. and substantially lower hydrogen partial pressure of 1200 psig using a high activity desulfurization catalyst, followed by withdrawal of used catalyst and repeated catalyst regeneration in accordance with the invention. The operating conditions used and results achieved at these conditions are also shown in Table 1 and by the series of short solid substantially parallel lines in FIG. 3 indicating catalyst deactivation following the repeated regenerations of the catalyst. These deactivation lines provide for a lower effective catalyst deactivation rate (as indicated by the dashed line) than for line A—B.

It is noted that by operating in accordance with the invention, equivalent 82% desulfurization of the feedstock can be achieved at only about one-half the usual hydrogen partial pressure and one-third the usual required catalyst replacement rate. Furthermore, when the usual catalyst replacement rate of 0.3 lb/bbl feed is used at the new reaction conditions, an appreciably higher 87% desulfurization feedstock is achieved.

TABLE 1

| FEEDSTOCK | KUWAIT VACUUM BOTTOMS* | | |
|---|---|---|---|
| Catalyst Used | Connention Bemodal 1/32 in Dia. Extrudates | High Activity monomodal (HDS-1441) | |
| REACTOR CONDITIONS USED | Usual Operations | Operations per The Invention | |
| Temperature, °F. | 780 | 800 | 800 |
| $H_2$ Partial Pressure, psig | 2250 | 1200 | 1200 |
| Liquid Space Velocity, $V_f$/hr/$V_4$ | | 0.4 | 0.4 |
| Catalyst Space Velocity, Bbl/day/lb | 0.1 | | 0.1 |
| Catalyst Replacement Rate, lb/Bbl feed | 0.3 | 0.1 | 0.3 |
| Percent Desulfurization | 82 | 82 | 87 |

*Feedstock Characteristics:
8.7 °API, 5.43% sulfur
85 ppm vanadium
35 ppm nickel Although this invention has been described broadly and in terms of specific embodiments, it will be understood that modifications and variations can be made and some steps used without others all within the spirit and scope of the invention, which is defined by the following claims.

We claim:

1. A process for the catalytic desulfurization of heavy petroleum residua feedstocks containing at least about 2 W% sulfur and less than about 400 ppm total metals to produce lower sulfur liquid products wherein the effective catalyst deactivation is minimized while catalyst age is increased, said process comprising:

(a) feeding the petroleum residua feedstock together with hydrogen into a reaction zone containing an ebullated catalyst bed of high activity desulfurization catalyst, said reaction zone being maintained at a 790°-860° F. temperature and 1000-1800 psig hydrogen partial pressure with a liquid space velocity of 0.2-2.0 $V_f$/hr/$V_r$ and a catalyst space velocity of 0.02-0.4 barrel/day/pound catalyst to provide at least about 75% desulfurization of the feed and to produce a hydroconverted hydrocarbon material;

(b) withdrawing used catalyst containing carbon deposits from said reaction zone at a rate of at least about 0.4 lb/bbl feed, discarding between 10 and 50 W% of said used catalyst, regenerating the remainder of said used catalyst to remove substantially all carbon deposits, and returning the regenerated catalyst to the reaction zone for further use along with fresh catalyst to minimize the catalyst effective deactivation rate and increase catalyst age; and (c) withdrawing said hydroconverted hydrocarbon material from said reaction zone, and phase separating and distilling the material to produce gas and lower boiling desulfurized hydrocarbon liquid products.

2. The process of claim 1, wherein said used catalyst containing carbon deposits is regenerated by carbon burnoff at 850°–900° F. temperature in a controlled atmosphere containing 2–6% oxygen with the remainder being substantially nitrogen, so as to have less than about 1.0% carbon remaining on the regenerated catalyst.

3. The process of claim 1, wherein the regenerated catalyst is presulfided before returning it to said reaction zone.

4. The process of claim 3, wherein said regenerated catalyst is presulfided by treatment with hydrogen sulfide.

5. The process of claim 1 wherein the fresh catalyst is presulfided before introducing it into said reaction zone to replace the discarded catalyst.

6. The process of claim 1, wherein said feedstock contains 3–6 W % sulfur and less than about 400 ppm total metals, and the reaction zone is maintained at 800°–840° F. temperature, 1200–1500 psig hydrogen partial pressure, and 0.3–1.5 $V_f$/hr/$V_r$ space velocity to achieve 80–90 W % desulfurization for the liquid products.

7. The process of claim 1, wherein the catalyst age achieved is at least about 2.5 bbl feedstock per pound catalyst consumed.

8. The process of claim 1, wherein said hydroconverted hydrocarbon material from said catalytic reaction zone is passed to a second stage catalytic reaction zone for further desulfurization.

9. The process of claim 8, wherein used catalyst is withdrawn from each of said first and second catalytic reaction zones, regenerated by carbon burn-off, and returned to the same reaction zone for further use.

10. A process for the catalytic desulfurization of heavy petroleum residua feedstocks containing at least about 3 W% sulfur to produce lower sulfur liquid products wherein the catalyst deactivation is minimized while the catalyst age is increased, said process comprising:

(a) feeding the petroleum residua feedstock together with hydrogen into a first reaction zone containing an ebullated catalyst bed of high activity desulfurization catalyst, said reaction zone being maintained at a 790°–860° F. temperature and 1000–1800 psig hydrogen partial pressure with a liquid space velocity of 0.2–2.0 $V_f$/hr/$V_r$ and a catalyst space velocity of 0.02–0.4 barrel/day/pound catalyst to provide at least about 80% desulfurization of the feed and to produce a hydroconverted hydrocarbon material;

(b) withdrawing said hydroconverted hydrocarbon material from said first reaction zone and passing it to a second catalytic reaction zone for further hydrodesulfurization to produce a hydroconverted and desulfurized hydrocarbon material;

(c) withdrawing used catalyst containing carbon deposits from said first reaction zone at a rate of at least about 0.4 lb/bbl feed, discarding between 10 and 50 W% of said used catalyst, regenerating the remainder of said used catalyst to remove substantially all carbon deposits thereon, and returning the regenerated catalyst to said first reaction zone for further use to minimize the catalyst effective deactivation rate and increase catalyst age;

(d) withdrawing used catalyst containing carbon deposits from said second reaction zone, transferring a portion of the used catalyst from said second reaction zone to said first reaction zone, regenerating the remainder of said used catalyst to remove substantially all carbon deposits thereon, and returning the regenerated catalyst to said second reaction zone for further use along with fresh catalyst to minimize the catalyst effective deactivation rate and increase catalyst age; and (e) withdrawing said hydroconverted and desulfurized hydrocarbon material from said second reaction zone, and phase separating and distilling the material to produce gas and lower boiling desulfurized hydrocarbon liquid products.

11. The process of claim 10, wherein the regenerated catalyst is presulfided before introducing it into said second stage reaction zone.

12. The process of claim 10, wherein said second stage reaction zone is maintained at 800°–850° F. and 950–1750 psig hydrogen partial pressure.

* * * * *